US008047392B2

(12) United States Patent
Eiten et al.

(10) Patent No.: US 8,047,392 B2
(45) Date of Patent: Nov. 1, 2011

(54) STACKABLE LIQUID CONTAINER

(75) Inventors: Carl T. Eiten, Byron, IL (US); Matthew J. Simpson, Tecumseh, MI (US)

(73) Assignee: Dean Intellectual Property Services II, Inc., Dallas, TX (US)

( * ) Notice: Subject to any disclaimer, the term of this patent is extended or adjusted under 35 U.S.C. 154(b) by 21 days.

(21) Appl. No.: 11/780,197

(22) Filed: Jul. 19, 2007

(65) Prior Publication Data

US 2008/0217200 A1 Sep. 11, 2008

Related U.S. Application Data

(60) Provisional application No. 60/893,061, filed on Mar. 5, 2007.

(51) Int. Cl.
*B65D 21/02* (2006.01)

(52) U.S. Cl. ..... 220/23.6; 206/504; 206/509; 220/4.26; 220/4.27; 220/380; 220/621

(58) Field of Classification Search ..... 206/504, 206/509; 220/4.26, 4.27, 23.6, 380, 621
See application file for complete search history.

(56) References Cited

U.S. PATENT DOCUMENTS

| | | | | |
|---|---|---|---|---|
| 255,900 | A | 4/1882 | Thorpe | |
| 353,600 | A | 11/1886 | Sloan | |
| 1,190,203 | A | 7/1916 | Sorge, Jr. | |
| 2,077,027 | A | 4/1937 | Torras | |
| 2,631,747 | A | 3/1953 | Stolte | |
| 2,641,374 | A * | 6/1953 | Der Yuen | 215/10 |
| D189,372 | S | 11/1960 | Adell | |
| 2,960,248 | A | 11/1960 | Kuhlman | |
| D199,203 | S | 9/1964 | Dailey | |
| 3,194,426 | A | 7/1965 | Brown, Jr. | |
| D203,226 | S | 12/1965 | Schnur et al. | |
| 3,323,668 | A | 6/1967 | Hills | |
| 3,369,658 | A | 2/1968 | Hasselmann | |
| 3,369,688 | A | 2/1968 | Dike | |
| 3,391,824 | A | 7/1968 | Wiseman | |
| 3,397,724 | A | 8/1968 | Bolen et al. | |
| 3,485,355 | A | 12/1969 | Stewart | |
| 3,708,082 | A | 1/1973 | Platte | |

(Continued)

FOREIGN PATENT DOCUMENTS

| | | |
|---|---|---|
| AU | 606090 | 11/1987 |

(Continued)

OTHER PUBLICATIONS

Combined Search and Examination Report under Sections 17 and 18(3) from the UK Intellectual Property Office; Reference: 075201.0126; Application No. GB0803837.4, Jun. 2, 2008.

(Continued)

*Primary Examiner* — Anthony Stashick
*Assistant Examiner* — Elizabeth Volz
(74) *Attorney, Agent, or Firm* — Baker Botts L.L.P.

(57) ABSTRACT

In one embodiment according to the present disclosure, a liquid container generally includes a base member, an annular sidewall member, a neck member, a spout, and a handle. The annular sidewall member is attached to and extends upwardly from the base member. The neck member couples the annular sidewall member to the spout. The base member has a recessed portion that extends upwardly into the container such that the base member may rest upon the neck member of another container.

6 Claims, 8 Drawing Sheets

U.S. PATENT DOCUMENTS

| | | | | |
|---|---|---|---|---|
| 3,765,574 | A | 10/1973 | Urquiza | |
| 3,819,847 | A | 6/1974 | Charles | |
| 3,889,834 | A | 6/1975 | Harris, Jr. | |
| 3,972,450 | A | 8/1976 | Walters | |
| 4,133,445 | A | 1/1979 | Mandelbaum | |
| 4,165,812 | A | 8/1979 | Jennison | |
| 4,170,082 | A | 10/1979 | Freedman | |
| 4,308,955 | A | 1/1982 | Schieser et al. | |
| 4,351,454 | A | 9/1982 | Maynard, Jr. | |
| D266,690 | S | 10/1982 | Levin | |
| 4,416,373 | A | 11/1983 | deLarosiere | |
| 4,433,954 | A | 2/1984 | Fujita | |
| 4,485,923 | A | 12/1984 | Schwaikert | |
| D282,244 | S | 1/1986 | Santoiemmo | |
| D282,347 | S | 1/1986 | Steiner | |
| 4,565,043 | A | 1/1986 | Mazzarese | |
| 4,570,799 | A | 2/1986 | Mednis | |
| 4,589,560 | A | 5/1986 | Harris, Jr. | |
| 4,609,106 | A | 9/1986 | Gentili | |
| 4,624,383 | A | 11/1986 | Moore | |
| 4,685,565 | A | 8/1987 | Sparling | |
| 4,691,828 | A | 9/1987 | Slusarczyk et al. | |
| 4,708,253 | A | 11/1987 | Mednis | |
| 4,793,516 | A | 12/1988 | Niwa et al. | |
| 4,805,793 | A | 2/1989 | Brandt et al. | 215/10 |
| 4,838,450 | A | 6/1989 | Bocchi | |
| D307,389 | S | 4/1990 | Larson | |
| 5,002,199 | A | 3/1991 | Frahm | |
| 5,064,101 | A | 11/1991 | Richter et al. | |
| 5,105,858 | A | 4/1992 | Levinson | |
| 5,119,972 | A | 6/1992 | Reed et al. | |
| 5,125,538 | A | 6/1992 | Morris, Sr. | |
| 5,133,469 | A | 7/1992 | Mehta et al. | |
| 5,217,128 | A | 6/1993 | Stenger | |
| 5,244,106 | A | 9/1993 | Takacs | |
| 5,299,710 | A | 4/1994 | Welsch et al. | |
| 5,312,011 | A | 5/1994 | Fischer | |
| 5,316,159 | A | 5/1994 | Douglas et al. | |
| 5,330,050 | A | 7/1994 | Stansbury, Jr. et al. | |
| 5,409,128 | A | 4/1995 | Mitchell | |
| 5,447,249 | A | 9/1995 | Vickers | |
| 5,516,562 | A | 5/1996 | Edwards et al. | |
| 5,535,910 | A | 7/1996 | Cassel | |
| 5,573,133 | A | 11/1996 | Park | |
| 5,697,500 | A | 12/1997 | Walker | |
| 5,699,925 | A | 12/1997 | Petruzzi | |
| 5,779,051 | A | 7/1998 | Boutin | |
| 5,782,358 | A | 7/1998 | Walker | |
| 5,833,115 | A | 11/1998 | Eiten | |
| 5,866,419 | A | 2/1999 | Meder | |
| D407,020 | S | 3/1999 | Doty | |
| 5,887,740 | A | 3/1999 | Hong | |
| 5,927,499 | A | 7/1999 | Vesborg | |
| D417,621 | S | 12/1999 | Hofmeister et al. | |
| 6,050,455 | A | 4/2000 | Soehnlen et al. | |
| 6,053,345 | A | 4/2000 | Jones | |
| 6,068,161 | A | 5/2000 | Soehnlen et al. | |
| 6,082,541 | A | 7/2000 | Bewick | |
| 6,095,332 | A | 8/2000 | Finand et al. | |
| 6,123,196 | A | 9/2000 | Chiu | |
| 6,202,881 | B1 | 3/2001 | Chiang | |
| 6,223,942 | B1 | 5/2001 | Markey et al. | |
| 6,230,892 | B1 | 5/2001 | Przytulla et al. | |
| 6,237,792 | B1 | 5/2001 | Skolnicki et al. | 215/382 |
| 6,269,949 | B1 | 8/2001 | Gottlieb | |
| 6,276,549 | B1 | 8/2001 | Fasci et al. | |
| 6,325,212 | B2 | 12/2001 | Przytulla et al. | |
| 6,367,631 | B1 | 4/2002 | Steigerwald | |
| 6,419,783 | B1 | 7/2002 | Rainey et al. | |
| 6,446,680 | B1 | 9/2002 | Soehnlen et al. | |
| 6,497,333 | B1 | 12/2002 | Ellis et al. | |
| 6,527,133 | B1 * | 3/2003 | McCollum et al. | 215/382 |
| 6,588,612 | B1 | 7/2003 | Dorn et al. | |
| 6,591,986 | B2 | 7/2003 | Soehnlen et al. | |
| D487,697 | S | 3/2004 | Rosen | |
| D489,271 | S | 5/2004 | Soomar | |
| 6,772,898 | B1 | 8/2004 | Florino et al. | |
| 7,097,059 | B2 | 8/2006 | Saito | |
| D532,694 | S | 11/2006 | Darr et al. | |
| 7,543,713 | B2 | 6/2009 | Trude et al. | |
| 7,726,106 | B2 | 6/2010 | Kelley et al. | |
| 7,735,304 | B2 | 6/2010 | Kelley et al. | |
| 2001/0045370 | A1 | 11/2001 | Soehnlen et al. | |
| 2002/0077225 | A1 | 6/2002 | Selsam | |
| 2003/0010743 | A1 | 1/2003 | Boukobza | |
| 2003/0121926 | A1 | 7/2003 | Soehnlen et al. | |
| 2003/0132184 | A1 | 7/2003 | Dorn et al. | |
| 2003/0196926 | A1 | 10/2003 | Tobias et al. | |
| 2003/0221987 | A1 | 12/2003 | Trude | |
| 2003/0234200 | A1 | 12/2003 | Diamant | |
| 2004/0178161 | A1 | 9/2004 | Galustyan | |
| 2006/0096942 | A1 * | 5/2006 | Lane | 215/10 |
| 2006/0255000 | A1 | 11/2006 | Quintana | 215/10 |
| 2006/0260971 | A1 | 11/2006 | Rivera et al. | 206/509 |
| 2007/0114200 | A1 | 5/2007 | Lane | |

FOREIGN PATENT DOCUMENTS

| | | | |
|---|---|---|---|
| CA | 2070899 | | 6/1992 |
| CA | 2141361 | | 1/1995 |
| CA | 2320789 | | 3/1999 |
| CN | CH 629148 | | 4/1982 |
| DE | 4014520 | | 11/1991 |
| EP | 705765 | | 9/1995 |
| EP | 771735 | | 5/1997 |
| EP | 8428859 | | 5/1998 |
| GB | 887893 | | 7/1959 |
| GB | 2344095 | | 5/2000 |
| GB | 2404915 | | 2/2005 |
| IT | EP1321370 | * | 12/2001 |
| JP | 11011451 | | 6/1997 |
| JP | 2001180635 | A | 12/1999 |
| JP | 2000072125 | | 3/2000 |
| JP | 2002114225 | | 4/2002 |
| JP | 2003072757 | | 3/2003 |
| JP | 2004182334 | | 7/2004 |
| WO | WO 8805014 | | 7/1988 |
| WO | WO 9206897 | | 4/1992 |
| WO | WO 9402368 | | 2/1994 |
| WO | WO 0162612 | | 2/2001 |
| WO | WO 2004011340 | | 2/2004 |

OTHER PUBLICATIONS

U.S. Appl. No. 12/562,661, inventor Eiten, "Liquid Container: System and Method for Use and Distribution Thereof," 37 pages plus 7 pages of drawings, filed Sep. 18, 2009.

U.S. Appl. No. 12/562,700, inventor Eiten et al., "Stackable Liquid Container with Tunnel-Shaped Base," 29 pages plus 7 pages of drawings, filed Sep. 18, 2009.

U.S. Appl. No. 60/629,780 to Rivera, et al. filed Nov. 20, 2004, 24 pages, Nov. 20, 2004.

"Stacking pc water bottle gives more capacity with less weight", Mod. Plast. Int. 11, No. 7, Jul. 1981, p. 19.

Stark, L. "Development of plastics containers for packaging milk products" Anyagmozgatas Csomagolas, 1984.

Grieb, et al., "Single-service plastics package, particularly plastics bottle." German Federal Republic Patent Application 1972.

* cited by examiner

STACKABLE LIQUID CONTAINER

RELATED APPLICATIONS

This application claims the benefit of priority under 35 U.S.C. §119(e) of U.S. Provisional Application Ser. No. 60/893,061, filed Mar. 5, 2007, and entitled "STACKABLE LIQUID CONTAINER."

TECHNICAL FIELD OF THE DISCLOSURE

This disclosure relates in general to containers and, more particularly, to a stackable liquid container providing enhanced structural integrity.

BACKGROUND OF THE DISCLOSURE

Liquid products are typically distributed from a manufacturer to consumers in liquid containers that may be easily handled and transported by the consumer. These liquid containers are generally formed of a liquid impermeable material that may be, for example, a thermoplastic, such as polyethylene or other similar material. The capacity of these liquid containers may be several gallons or less such that handling and transport of the containers do not create an undue burden to the consumer.

Known liquid product distribution practices have utilized ancillary support structures, such as the commonly known "milk crate." The milk crate is a generally rigid structure into which a number of liquid containers may be placed and has an upper rim that provides for support of another milk crate disposed above. The milk crate enables stacking of multiple liquid containers, one upon another, by alleviating downward directed forces from the liquid containers stored inside.

SUMMARY OF THE DISCLOSURE

In one embodiment according to the present disclosure, a liquid container generally includes a base member, an annular sidewall member, a neck member, a spout, and a handle. The annular sidewall member is attached to and extends upwardly from the base member. The neck member couples the annular sidewall member to the spout. The base member has a recessed portion that extends upwardly into the container such that the base member may rest upon the neck member of another container.

In another embodiment, a liquid container generally includes a base member, an annular sidewall member, a neck member, a spout, and a handle. The annular sidewall member is attached to and extends upwardly from the base member. The neck member couples the annular sidewall member to the spout. The annular sidewall member has a sidewall protruding portion and a sidewall indented portion, the sidewall protruding portion having an outer contour that generally conforms to an inner contour of the sidewall indented portion.

Embodiments of the disclosure may provide numerous technical advantages. Some, none, or all embodiments may benefit from the below described advantages. According to one embodiment, the liquid container may have a recessed portion that projects upwardly from the base member such that the base member may rest upon the neck member of another container. This structural feature may provide distribution of weight that is applied from one liquid container disposed upon another to be distributed over a relatively larger portion of the liquid container than known liquid container designs. The enhanced structural integrity provided by the recessed portion may enable stacking multiple liquid containers, one upon another, without the use of ancillary support structures, such as milk crates.

Other technical advantages will be apparent to one of skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS OF THE DISCLOSURE

As described previously, known liquid containers for consumer products such as milk, may be stored in milk crates, due to their relatively delicate nature. These milk crates protect the liquid container from damage by alleviating downward directed forces from other items stored on top. This is because known liquid container designs may not be configured to support the weight of other liquid containers. Usage of these milk crates, however, is a generally inefficient practice. That is, these milk crates serve little purpose to the consumer and therefore are transported back to the manufacturer following distribution to the consumer. It would therefore, be beneficial to provide a liquid container that alleviates the costs and burden associated with shipping and storage of a plurality of liquid containers in known ancillary support structures, such as milk crates.

Figure 1:
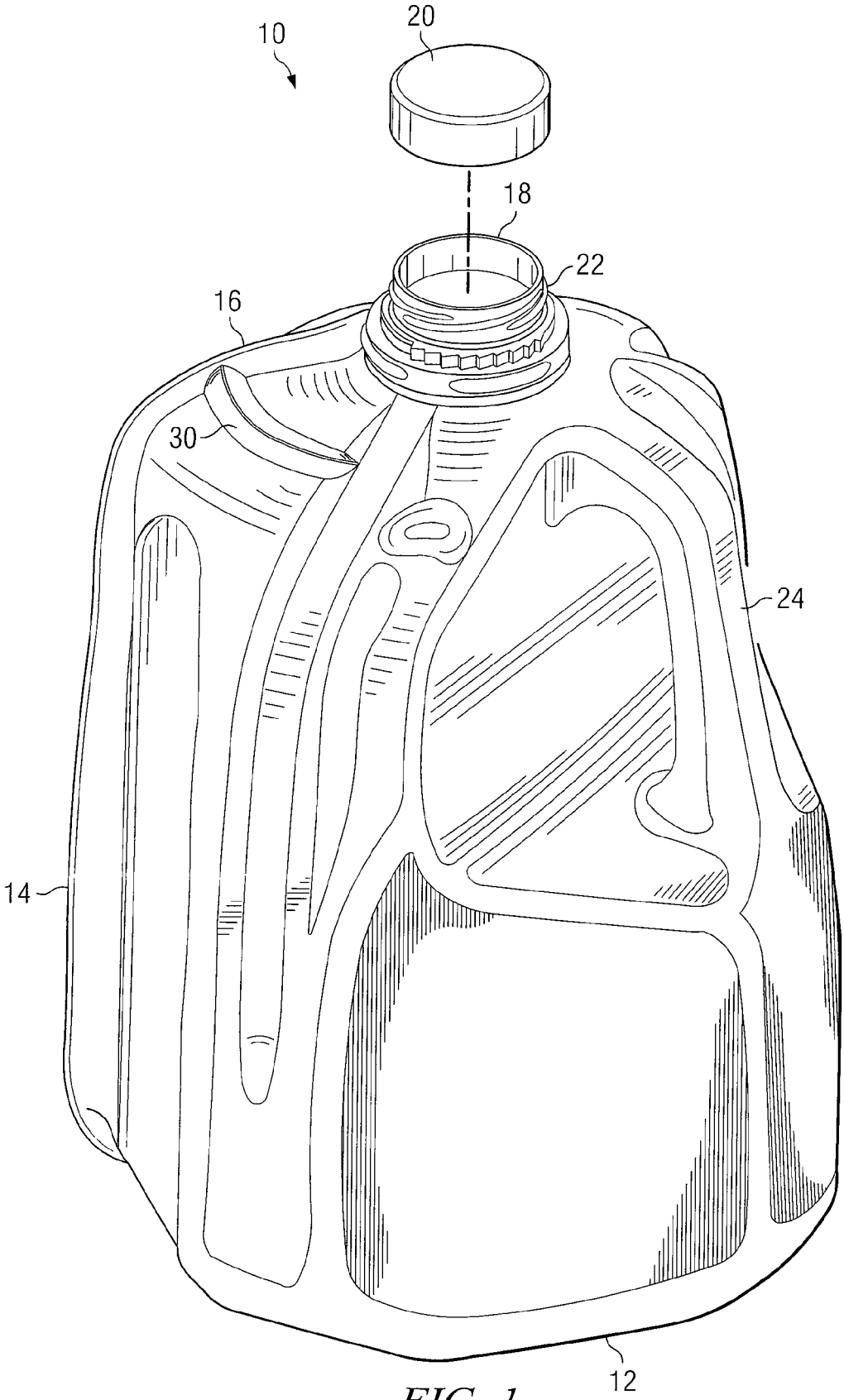
FIG. 1 is a perspective view of one embodiment of a liquid container according to the teachings of the present disclosure.

FIG. 1 shows one embodiment of a liquid container 10 that may provide a solution to these needs as well as other needs. Liquid container 10 has a number of features that may enable stacking of multiple containers 10, one upon another. In one embodiment, the container 10 of the present disclosure provides for the stacking of multiple containers 10 one upon another, without the need for extraneous ancillary support structures, such as known milk crate designs.

Liquid container 10 generally includes a base member 12, an annular sidewall member 14, a neck member 16, a spout 18, and a handle 24. The annular sidewall member 14 is integrally formed and extends upwardly from the base member 12. The upper end of the annular sidewall member 14 is interconnected to the spout 18 by the generally frusto-conical shaped, upwardly converging neck member 16. Together, the base member 12, annular sidewall member 14, neck member 16, and spout 18 forms a chamber for the storage and containment of a liquid therein. In a normal upright orientation, the base member 12 lies in a generally horizontal orientation such that the spout 18 exists at the apex of the liquid container 10. The spout 18 comprises a generally hollow opening for pouring liquids to and from the container 10.

The spout 18 may also have an associated closure cap 20 for removable placement over the spout 18. In the particular embodiment shown, thread-like ridges 22 may be included on the outer periphery of the spout 18 for securing the closure cap 20 to the spout 18. However, the cap 20 may comprise any type of industry standard dairy cap having screw-on, snap-on, or similar type selective attachment means. Caps of this nature may be available from Portola, located in Batavia, Ill.

Figure 2:
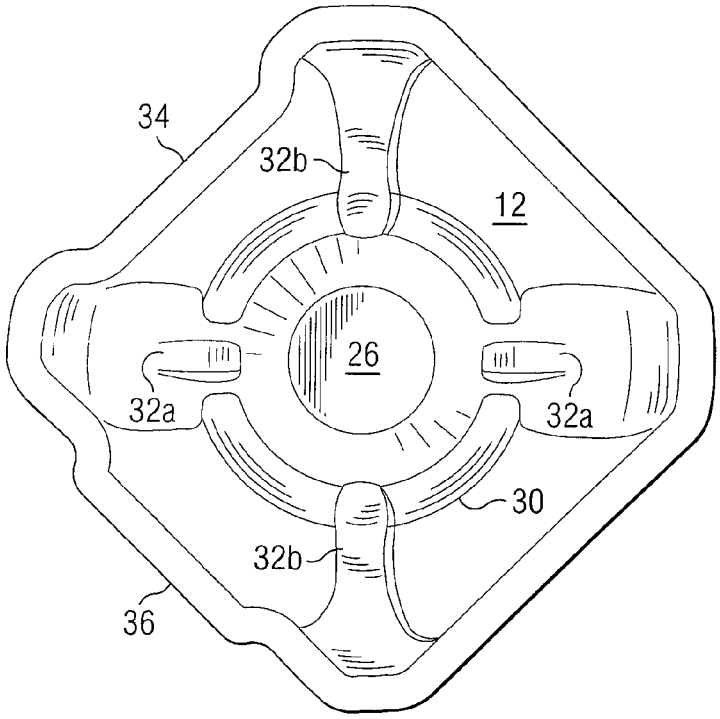
FIG. 2 is a bottom view of the embodiment of FIG. 1.

FIG. 2 is a bottom view showing various features of the base member 12. Base member 12 has a recessed portion 26 and a number of slots 32 including, for example, slots 32A and/or 32B. The recessed portion 26 and slots 32 project upwardly from the base member 12 for reasons to be described below. With the exception of the recessed portion 26 and slots 32, the base member 12 is generally flat in shape for relatively stable placement of the liquid container 10 on a flat surface, such as a tabletop.

Figure 3:
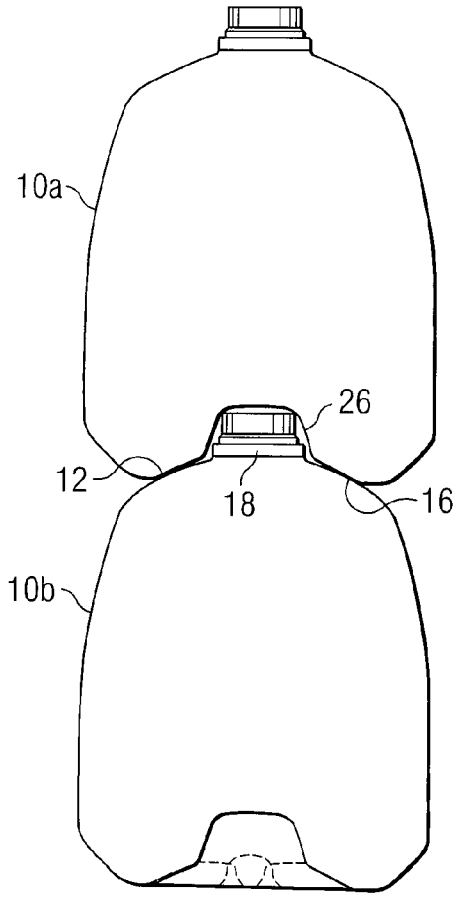
FIG. 3 is a cut-away, elevational view of two liquid containers according to the embodiment of FIG. 1 in which one liquid container is stacked on top of another.

FIG. 3 is a cut away, elevational view showing the arrangement of one liquid container 10*a* that is stacked on top of another liquid container 10*b*. Support for another liquid container 10*a* on top of liquid container 10*b* may be provided by recessed portion 26. The recessed portion 26 projects upwardly into the container 10, such that the base member 12 of liquid container 10*a* may rest upon the neck member 16 of liquid container 10*b*. Because the recessed portion 26 allows the base member 12 of one container 10*a* to rest upon the neck member 16 of another container 10*b*, the weight of container 10*a* and its liquid contents may be generally evenly distributed around the upper surface of the neck member 16 of container lob in close proximity to the annular sidewall member 14.

The spout 18 is significantly smaller in diameter than the annular sidewall member 14 such that the neck member 16 converges from the annular sidewall member 14 to the spout 18 in a generally frusto-conical shape. This upwardly converging shape however, does not easily lend itself to transferring downward directed forces caused by the weight of liquid container 10*a* placed directly upon the spout 18 of container 10*b*. The teachings of the present disclosure provide a solution to this need via a liquid container 10 having a base member 12 that is configured to rest directly upon the neck member 16 of another container lob such that downward directed forces caused by the weight of the container 10*a* and its contents, are efficiently transferred to the annular sidewall member 14 of the container 10*b* disposed underneath.

Figure 4:
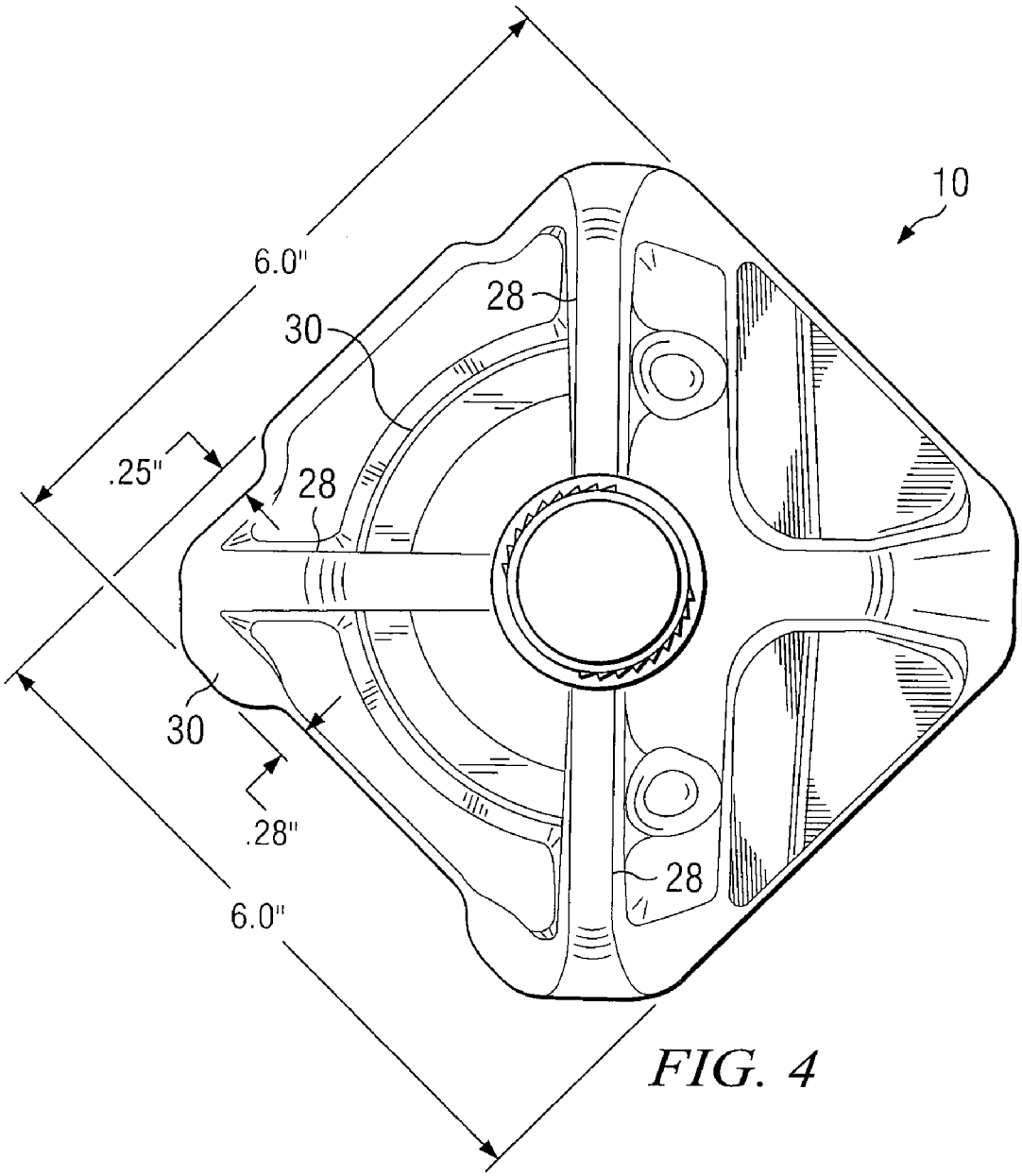
FIG. 4 is a top view of the embodiment of FIG. 1.
Figure 5:
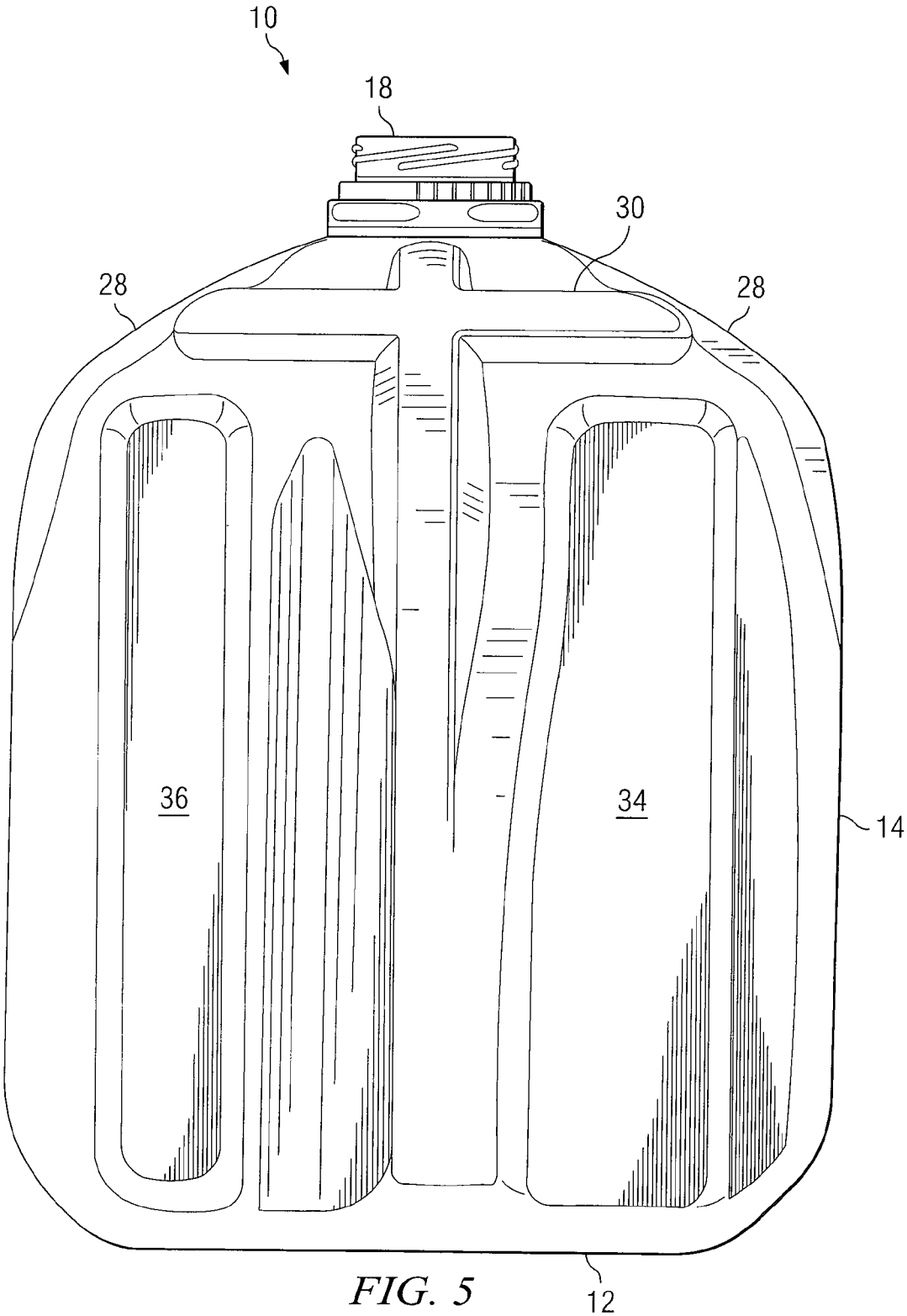
FIG. 5 is a front side elevational view of the embodiment of FIG. 1.

FIG. 4 shows a top view of the embodiment of FIG. 1. In one embodiment, the neck member 16 may have at least one rib 28 that extends from the spout to the annular sidewall member 14. In this particular embodiment, three ribs 28 are configured on the neck member 16. It should be appreciated however, that any quantity of ribs 28 may be utilized within the teachings of the present disclosure. The ribs 28 may provide enhanced structural rigidity by transferring localized forces incident upon the neck member onto the annular sidewall member 14. The ribs 28 may also transfer forces incident upon the spout 18 toward the annular sidewall member 14. The ribs 28 may operate in conjunction with handle 24 in order to form a relatively robust structure for distributing weight placed upon the liquid container 10 in a generally even manner. In order to evenly distribute the weight around the entire periphery of the annular sidewall member 14, the ribs 28 and handle 24 may be evenly spaced around the neck member 16 of the liquid container 10.

In another embodiment, the neck member 16 may also have a support projection 30. Support projection 30 extends upwardly from the neck member 16 and extends over at least a radial portion of the neck member 16. In one embodiment, support projection 30 is generally semi-circular in shape. Support projection 30 may provide a relatively stable support surface for the base member 12 of another liquid container 10 placed on top. In certain embodiments, support projection 30 may enhance the stability of one container 10 when placed on top of another container 10 by supporting the container 10 at the base member 12, which is generally flat in shape.

In one embodiment, the recessed portion 26 has a contour that generally conforms to the contour formed by the neck member 16, closure cap 20, ribs 28, handle 24, support projection 30, and any other structural member that extends generally upwardly from the neck member 16 or spout 18 of the liquid container 10. The ribs 28 may be configured on neck member 16 such that they at least partially fit into cavities formed by slots 32 in base member 12. When fitted into slots 32, the ribs 28 may prevent rotation of one particular liquid container 10 that is stacked upon another liquid container 10.

Reference will now be made to FIGS. 5 through 8 showing front, rear, right, and left side elevational views, respectively, of the embodiment of FIG. 1 which includes a recessed portion having one or more slots 32 (e.g., 32B). In one embodiment, annular sidewall 14 has a sidewall indented portion 34 and a sidewall protruding portion 36 for improved lateral support of another liquid container 10 that is stacked in a side-by-side arrangement. The sidewall protruding portion 36 extends from the base member 12 to neck member 16 and is generally convex in shape to fit at least partially inside of the sidewall indented portion 34 of another container 10. In the particular embodiment shown, the sidewall indented portion 34 and sidewall protruding portion 36 is generally linear in shape from base member 12 to neck member 16. It should be appreciated, however, that sidewall indented portion 34 and sidewall protruding portion 36 may have any shape that allows at least a portion of the sidewall protruding member 36 to rest inside at least a portion of the sidewall indented portion 34.

Figure 9:
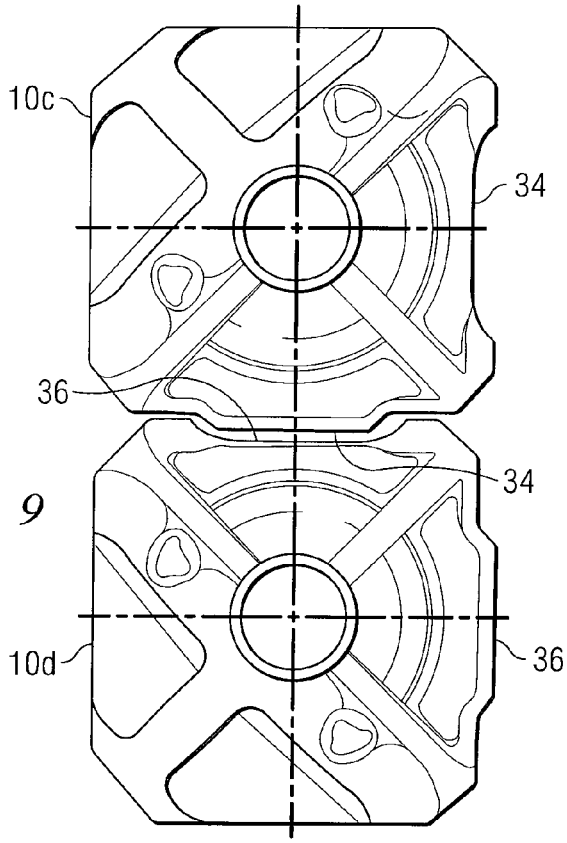
FIG. 9 is a top view of two liquid containers according to the embodiment of FIG. 1 that are stacked together in a side-by-side configuration.

FIG. 9 is a top view of liquid containers 10C and 10D that are stacked in a side-by-side configuration. As can be seen, sidewall protruding portion 36 fits at least partially into sidewall indented portion 34. Certain embodiments incorporating sidewall protruding portion 36 and sidewall indented portion 34 may provide an advantage in that lateral stability of one liquid container 10 (e.g., 10C) relative to another (e.g., 10D) may be enhanced when stacked in a side-by-side configuration.

Certain embodiments incorporating a sidewall indented portion 34 and a sidewall protruding portion 36 may provide an advantage in that removal of one particular liquid container 10 from a number of liquid containers 10 stacked together may be enhanced by encouraging a lifting action upwards on the liquid container 10 rather than using a lateral movement action. Advantages that may be provided by embodiments incorporating sidewall indented portion 34 and sidewall protruding portion 36 may include enhanced loading capability of the annular sidewall member 14 from downward directed forces on the neck member 16.

Figure 6:
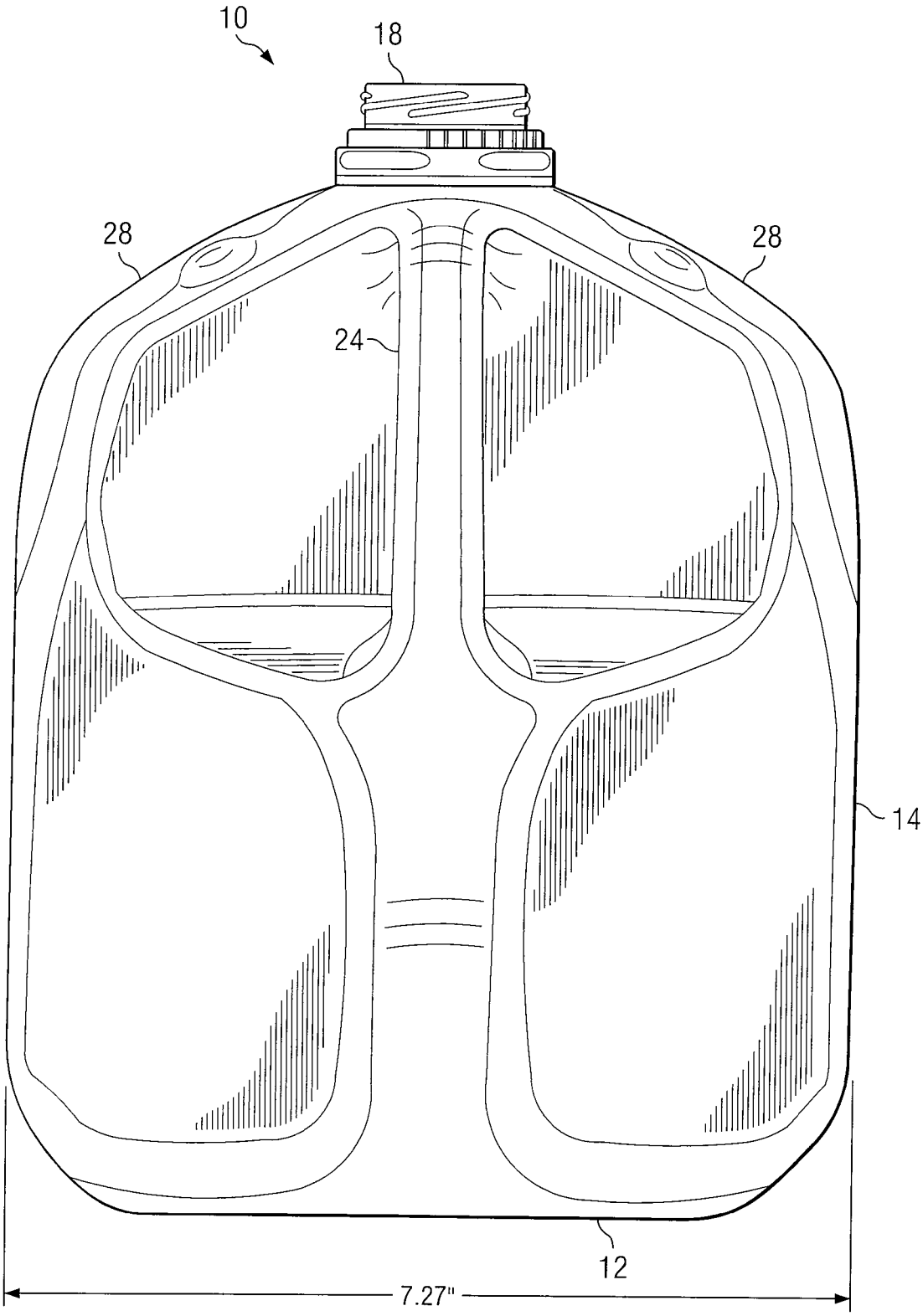
FIG. 6 is a rear side elevational view of the embodiment of FIG. 1.
Figure 7:
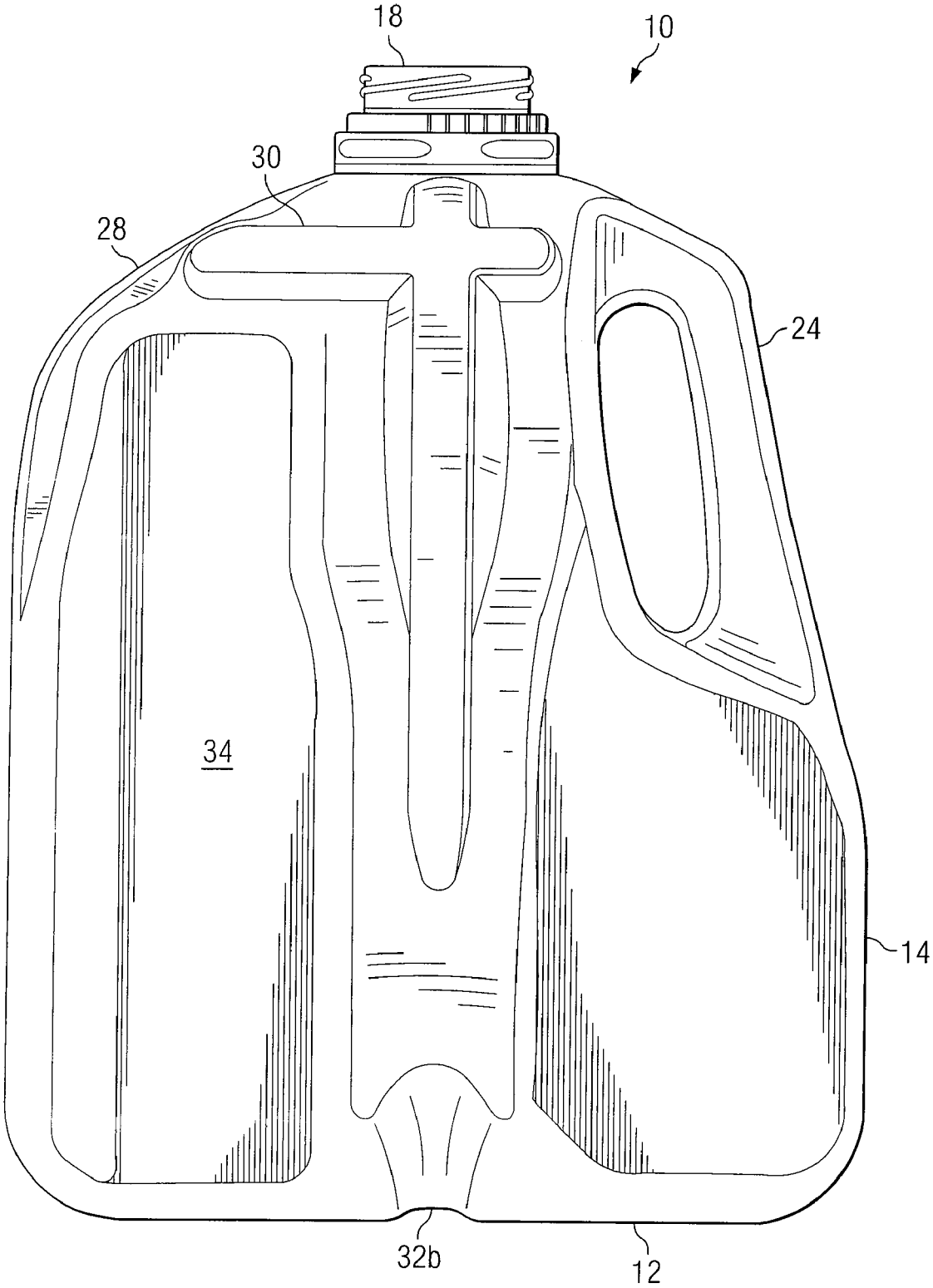
FIG. 7 is a right side elevational view of the embodiment of FIG. 1.
Figure 8:
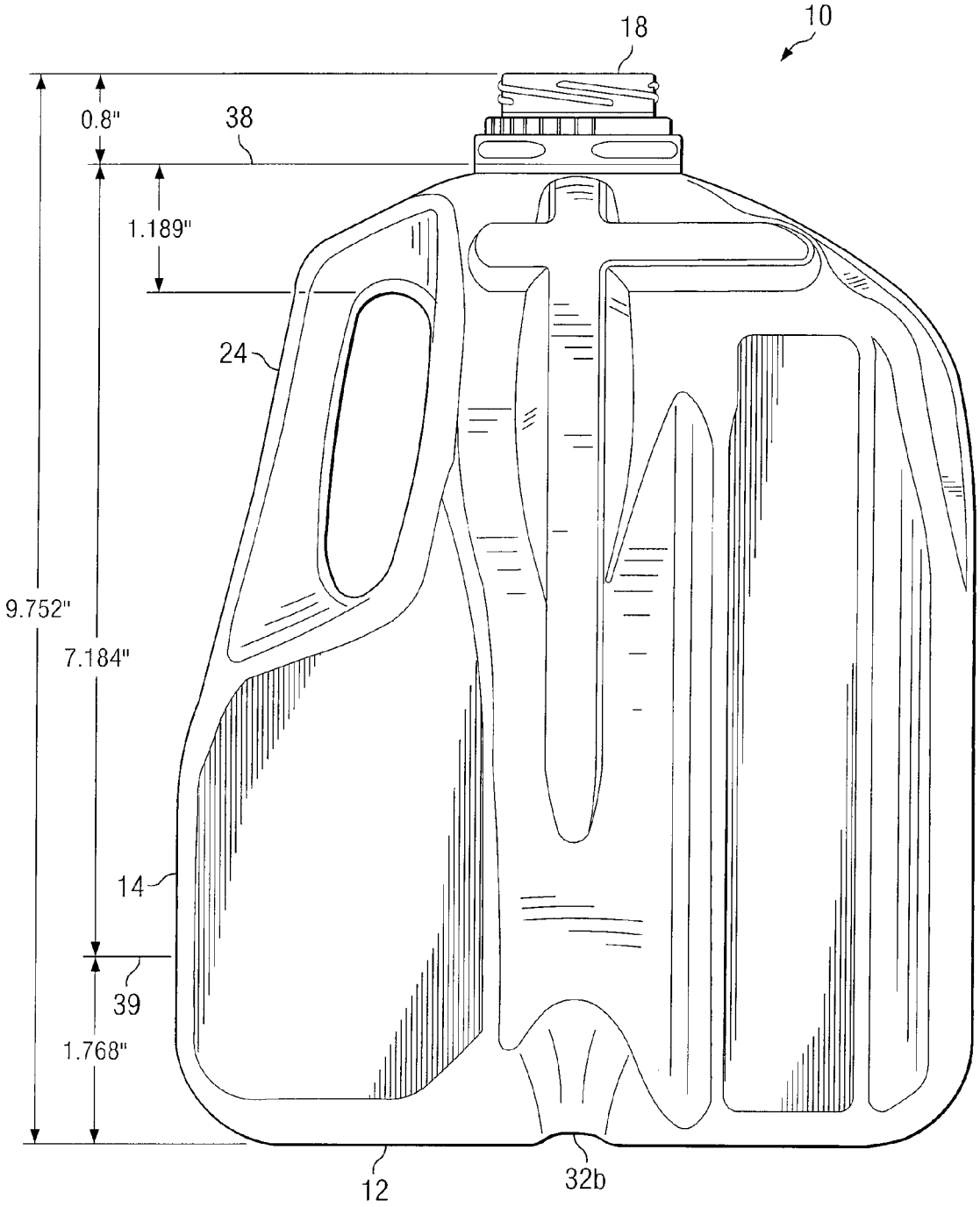
FIG. 8 is a left side elevational view of the embodiment of FIG. 1.

FIGS. 4, 6, and 8 show several dimensions of one embodiment of liquid container 10 according to the teachings of the present disclosure. The liquid container 10 as shown has a generally square-shaped base member 12 having an overall height of 9.752 inches, a width of 6.00 inches, and depth of 6.00 inches. The diagonal width of the container 10 may be 7.27 inches. For dimensioning purposes, the container 10 may have a neck split 38 and a bottom split 39. The spout 18 may be 38 millimeters in diameter and extends 0.80 inches from the neck split 38. The base of the spout 18 is 1.189 inches above a cavity formed by handle 24. The neck split 38 exists 7.184 inches from the bottom split 39. The bottom split 39 is 1.768 inches above the base member 12. The indented member 34 extends 0.28 inches into the annular sidewall member 14 and the protrusion 36 extends 0.25 inches out of the annular sidewall member 14.

The particular liquid container 10 as disclosed is configured to have a fill capacity of 128.0 fluid ounces and an overflow capacity of 128.7 fluid ounces. It will be understood however, that a container having other capacities could be constructed using the teachings of this disclosure. Moreover, containers having different sizes, configurations, and/or fill capacities other than 128.0 fluid ounces may have dimensions other than those previously described.

The container 10 may be particularly suited for transport and distribution of various types of liquid products from a manufacturer to consumers. The type of liquid products may include consumable foodstuffs such as juice, water, milk, and the like, or other types of liquids such as chemical formulations for home, automotive, commercial, or industrial use. The liquid container 10 may be constructed of a high density polyethylene (HDPE) plastic material, which is generally "food safe", for storage of human consumable liquids. However, the liquid container 10 may formed from any suitable plastic material appropriate for the type of liquid it is adapted to contain. Nevertheless, the present embodiment may be formed using conventional blow molding techniques, which are well known to those skilled in the art.

Figure 10:
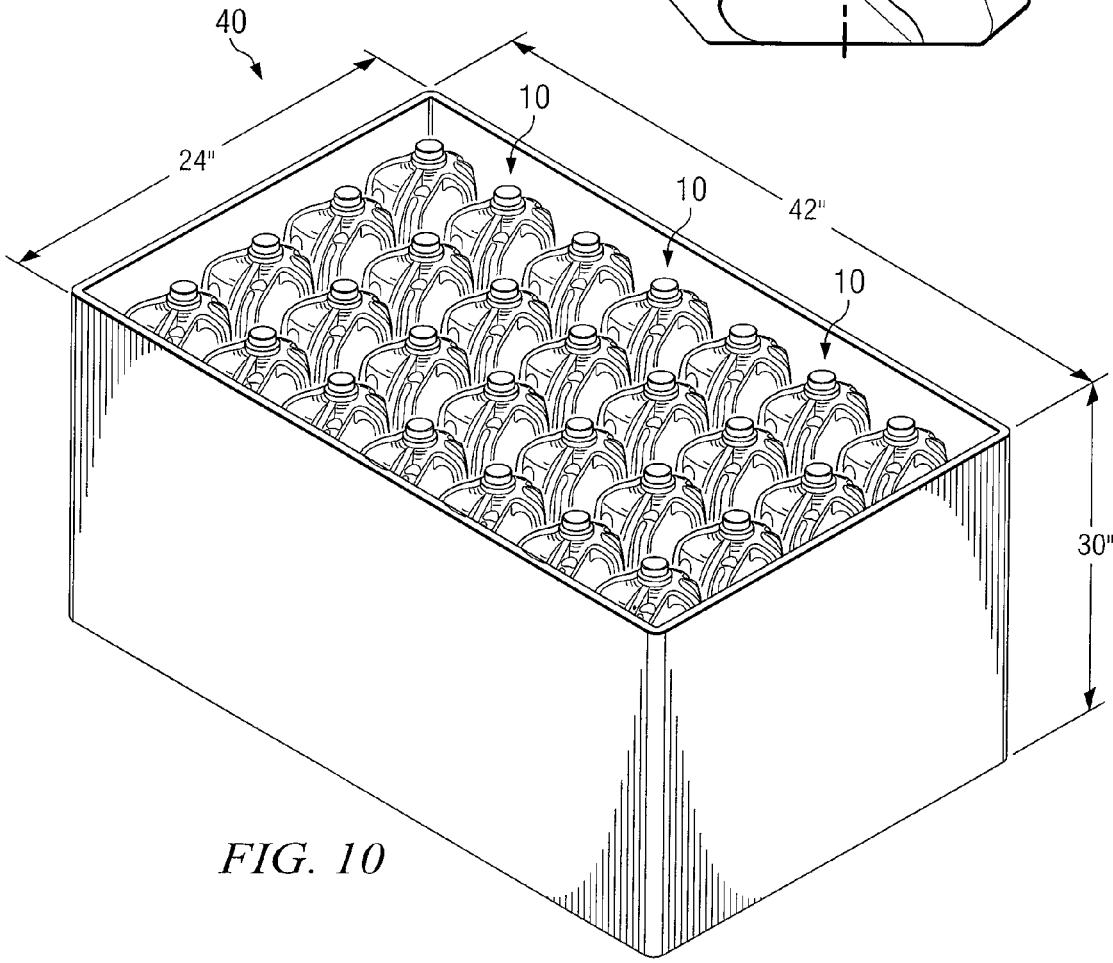
FIG. 10 is a perspective view of several liquid containers of the embodiment of FIG. 1 that have been stacked together in a collapsible crate.

FIG. 10 shows one example of an implementation of a number of liquid containers 10 that have been stacked together on top of one another as well as in a side-by-side configuration. In this particular implementation, the liquid containers 10 are stacked inside of a collapsible crate 40. Collapsible crate 40 may dimensioned such that any suitable number of liquid containers 10 may be stored inside. In this particular collapsible crate 40, liquid containers 10 are stacked in a seven by four by three configuration in which a total of eighty-four liquid containers 10 may be stored. It should be appreciated, however, that collapsible crate 40 may be configured for the storage of any configuration of liquid containers 10.

The crate 40 may be made of any generally rigid material that is sufficiently sturdy to support the weight of at least another crate disposed above. In one embodiment, the crate 40 is formed of a plastic material, such as polyurethane. Crates 40 of this nature may be available from Orbis Corporation, located in Oconomowoc, Wis. The particular crate 40 as shown may have a height of approximately 30 inches, a width of approximately 42 inches, and a depth of approximately 24 inches. It should be appreciated, however, that collapsible crate 40 may have any suitable dimensions for the storage of a number of liquid containers 10.

Certain embodiments incorporating the collapsible crate 40 for storage of a number of liquid containers 10 may provide an advantage in that access to the liquid containers 10 may be provided from the top of the collapsible crate 40. The collapsible crate 40 may be placed in a retail environment, such as a grocery store, for direct access to liquid containers 10 by consumers. Using the collapsible crate 40, consumers may be encouraged to remove individual liquid containers 10 from the collapsible crate 40 using a lifting motion rather than a lateral motion. A lifting motion is preferred over a lateral motion, since a lateral motion may tend to dislodge or tip container(s) 10 in the row(s) below the individual container 10 being removed.

Although an embodiment of the disclosure has been described using specific terms, such description is for illustrative purposes only. The words used are words of description rather than of limitation. It is to be understood that changes and variations may be made by those of ordinary skill in the art without departing from the spirit or scope of the present disclosure, which is set forth in the following claims. Therefore, the spirit and scope of the appended claims should not be limited to the description of the embodiments disclosed therein.

What is claimed is:

1. A container for liquids, comprising:

a base member;

an annular sidewall member that is attached to and extends upward from the base member;

a spout for receiving an associated closure cap for removable placement on and off of the spout;

an upwardly converging neck member that couples the annular sidewall member and the spout; and a handle that is attached to the container proximate the neck member;

wherein the base member has a recessed portion that extends upwardly into the container such that the base member may rest upon the neck member of another container, the recessed portion having a lower contour that generally conforms to at least a portion of an upper contour formed by the neck member and closure cap when selectively disposed on the spout;

wherein the neck member has a support projection that extends upwards from the neck member, the support projection extending over at least a radial portion of the neck member, the support projection operable to support at least some of the weight directed upon the neck member due to the another container physically contacting a portion of the neck member located between the support projection and the spout;

wherein the neck member comprises at least one rib that extends from the spout and traverses at least a portion of the annular sidewall member, the handle being radially spaced apart on the neck member from the at least one rib, the at least one rib configured to transfer incident forces from the neck member to the annular sidewall member;

wherein the recessed portion having at least one slot that generally conforms to the at least one rib of the neck member to allow the at least one rib of one container to engage with at least one slot of another container; and wherein the annular sidewall member has a sidewall protruding portion and a sidewall indented portion, the sidewall protruding portion having an outer contour that generally conforms to an inner contour of the sidewall indented portion, the sidewall protruding portion and the sidewall indented portion each extending from the base member to the neck member of the container.

2. The container of claim 1, wherein the at least one rib is three ribs.

3. The container of claim 1, wherein the support projection is generally semi-circular in shape.

4. The container of claim 1, wherein the base member is generally square in shape.

5. The container of claim 1, wherein the spout is centrally disposed over the base member.

6. A container for liquids, comprising:

a base member;

a sidewall member that is attached to and extends upwardly from the base member;

a spout; and an upwardly converging neck member that couples the sidewall member and the spout;

wherein the base member includes a recessed portion that extends upwardly into the container; and wherein the neck member includes a support projection that extends upwardly from the neck member, the support projection extending over at least a radial portion of the neck member; and the container operable to be stacked with a second container by:

nesting the spout within the recessed portion of the second container such that the base member of the second container rests upon the support projection and physically contacts a portion of the neck member located between the support projection and the spout; and wherein the support projection supports at least some of the weight that the second container directs upon the portion of the neck member.

* * * * *